US010245568B2

(12) United States Patent
Drocco et al.

(10) Patent No.: US 10,245,568 B2
(45) Date of Patent: Apr. 2, 2019

(54) AUTOMATED SYSTEM TO ASSOCIATE AN AGITATOR WITH A RESPECTIVE CONTAINER FOR CONTAINING FLUID AND METHOD THEREOF

(71) Applicants: Luca Drocco, Alba (IT); Mario Drocco, Alba (IT)

(72) Inventors: Luca Drocco, Alba (IT); Mario Drocco, Alba (IT)

( * ) Notice: Subject to any disclaimer, the term of this patent is extended or adjusted under 35 U.S.C. 154(b) by 190 days.

(21) Appl. No.: 15/310,634

(22) PCT Filed: May 5, 2015

(86) PCT No.: PCT/IB2015/053260
§ 371 (c)(1),
(2) Date: Nov. 11, 2016

(87) PCT Pub. No.: WO2015/173688
PCT Pub. Date: Nov. 19, 2015

(65) Prior Publication Data

US 2017/0080394 A1 Mar. 23, 2017

(30) Foreign Application Priority Data

May 13, 2014 (IT) ..... TO2014A0378

(51) Int. Cl.
*B01F 7/16* (2006.01)
*B01F 13/00* (2006.01)
(Continued)

(52) U.S. Cl.
CPC ..... *B01F 7/161* (2013.01); *B01F 13/0038* (2013.01); *B01F 13/0044* (2013.01);
(Continued)

(58) Field of Classification Search
CPC ..... B01F 7/161
(Continued)

(56) References Cited

U.S. PATENT DOCUMENTS 2,169,607 A * 8/1939 Kelley ..... A47J 43/105 366/343
2,847,198 A * 8/1958 Smith ..... A47J 43/0711 366/301
(Continued)

FOREIGN PATENT DOCUMENTS

DE 29 22 263 A1 12/1980
EP 0 546 715 A1 6/1993
(Continued)

OTHER PUBLICATIONS

International Preliminary Report on Patentability and Written Opinion for International Application No. PCT/IB2015/053260, dated Nov. 15, 2016, 7 pages.
International Search Report and Written Opinion for International Application No. PCT/IB2015/053260, dated Sep. 3, 2015, 10 pages.

*Primary Examiner* — David L Sorkin
(74) *Attorney, Agent, or Firm* — Merchant & Gould P.C.

(57) ABSTRACT

An automated system associates an agitator with a respective container for containing fluid, such as paint. The system includes a plurality of agitators; a storage area where the plurality of agitators are arranged; a moving device for moving the agitators at least between the storage area and the container; and a control system for controlling and coordinating the operations of the system. The agitators include a locking mechanism for removably fixing the agitator to the respective container.

14 Claims, 16 Drawing Sheets

(51) Int. Cl.
*B01F 13/10* (2006.01)
*B01F 15/00* (2006.01)

(52) U.S. Cl.
CPC ..... *B01F 13/1055* (2013.01); *B01F 13/1058* (2013.01); *B01F 13/1072* (2013.01); *B01F 15/00006* (2013.01); *B01F 15/00025* (2013.01); *B01F 15/0072* (2013.01); *B01F 2015/0011* (2013.01); *B01F 2215/005* (2013.01)

(58) Field of Classification Search
USPC ..... 366/251, 281, 282, 331, 343
See application file for complete search history.

(56) References Cited

U.S. PATENT DOCUMENTS

| | | | | |
|---|---|---|---|---|
| 4,079,917 | A * | 3/1978 | Popeil | A47J 43/082 366/244 |
| 2006/0097093 | A1 | 5/2006 | Hockmeyer | |
| 2013/0126436 | A1 * | 5/2013 | Ok | B03C 1/30 210/695 |

FOREIGN PATENT DOCUMENTS

| | | | |
|---|---|---|---|
| JP | S60-225631 | A | 11/1985 |
| WO | 89/11241 | A1 | 11/1989 |

* cited by examiner

AUTOMATED SYSTEM TO ASSOCIATE AN AGITATOR WITH A RESPECTIVE CONTAINER FOR CONTAINING FLUID AND METHOD THEREOF

This application is a National Stage Application of International Application No. PCT/IB2015/053260, filed 5 May 2015, which claims benefit of Serial No. TO2014A000378, filed 13 May 2014 in Italy and which applications are incorporated herein by reference. To the extent appropriate, a claim of priority is made to each of the above disclosed applications.

TECHNICAL FIELD

The present invention relates to an automated system to associate an agitator with a respective container for containing fluid, such as paint, in a releasable manner, and to the method thereof.

TECHNOLOGICAL BACKGROUND

In field of fluid production, systems and methods are known, which are used to mix different fluid components, if necessary with the addition of powdery substances, so as to obtain finished fluid products. Therefore, operators need to mix the different components, so as to obtain a finished or semifinished product that is as most homogeneous as possible.

Sometimes, in particular in the field concerning the production of paints, dyes, colors and the like, there is the need to agitate/mix the components simultaneously with the processing steps, such as for example the insertion of a further fluid or powdery product. As a matter of fact, some unstable fluids need to be kept under agitation as continuously as possible.

Containers are known, which have, on the inside, agitators the are designed to agitate the fluid contained therein in a substantially continuous manner.

This solution has different technical drawbacks, such as the difficulty of cleaning the blades of the agitator and the container itself, due to the presence of the agitation blades.

Furthermore, systems for the production of fluids, such as paints, are known, wherein, subsequent to dosing steps for pouring one or more fluids into a container, the latter is agitated in order to obtain a homogeneous product.

This kind of system uses one single type of agitation means, e.g. a blade, for all the containers available in the production plant, thus making it impossible for operators to work on different containers at the same time.

Furthermore, these systems are designed to manage containers having one single format, thus making it impossible for operators, unless they are willing to make expensive changes, to vary the type of container, both in terms of size and in terms of shape.

SUMMARY OF THE INVENTION

An object of the present invention is to provide an automated system to associate an agitator with a respective container for containing fluid, which is able to solve this and other drawbacks of the prior art and, at the same time, can be produced in a simple and economic fashion, and the method Thereof.

In particular, one of the technical problems solved by the present invention is that of providing an automated system to associate an agitator with a respective container for containing fluid, so as to allow the fluid to be agitated on the inside of the container and so as to separate the agitator from the container at the end of the operations, and the method thereof.

A further object of the present invention is to provide a system and a method to associate a respective agitator with container having different shapes and sizes, thus allowing the system to be more practical and flexible to be used and, therefore, more efficient.

A further object of the present invention is to provide a method to associate an agitator with a respective container for containing fluid in an automated manner, thus reducing production times and increasing the operators' safety.

BRIEF DESCRIPTION OF THE DRAWINGS

Further features and advantages of the present invention will be best understood upon perusal of the following detailed description, which is provided by way of example and is not limiting, with reference, in particular, to the accompanying drawings, wherein:

FIG. 5*a* shows a locking mechanism in a disengaged condition; whereas FIG. 5*b* shows the locking mechanism in an engaged configuration;

FIG. 9*a* shows the step in which the agitator still is on the outside of the washing chamber, FIG. 9*b* shows the step in which the agitator, still on the outside of the washing chamber, is rotated, FIG. 9*c* shows the step in which the agitator is partially inserted into the washing chamber, FIG. 9*d* shows the step in which the partially inserted agitator is rotated again, FIG. 9*e* shows the step in which the agitator is secured to the washing chamber;

DETAILED DESCRIPTION OF THE INVENTION

Figure 1:
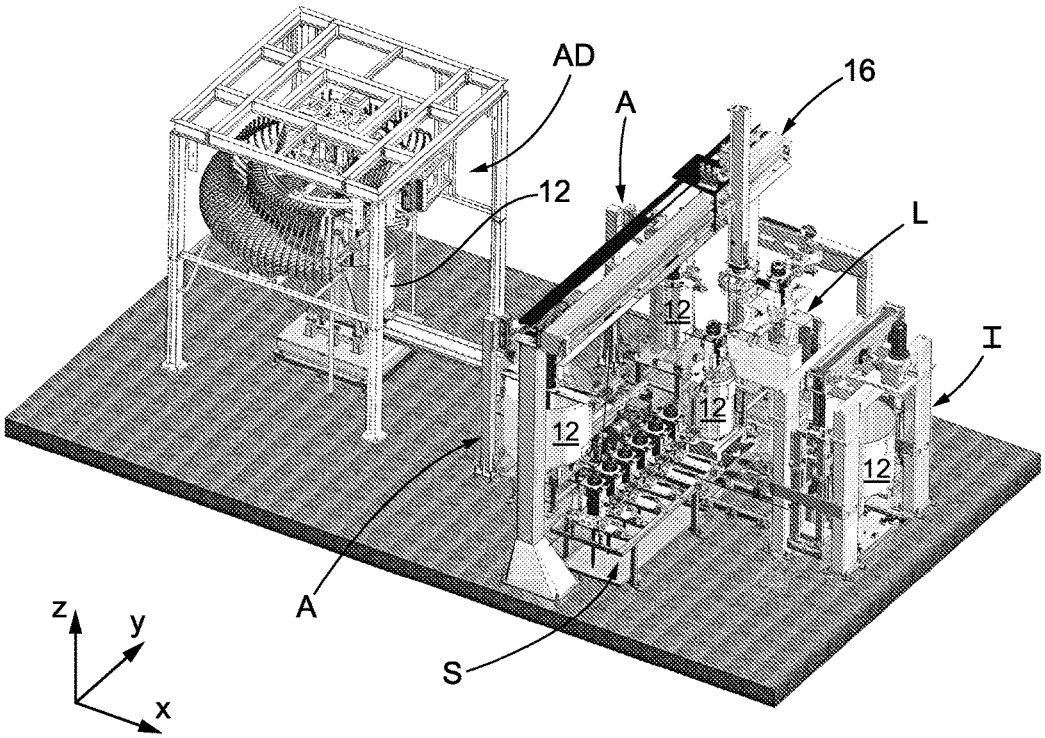
FIG. 1 is a perspective view of a system according to a first embodiment of the present invention.

FIG. 1 shows, as a whole, an automated system to associate an agitator 10 with a respective container 12 for containing fluid according to a first non-limiting embodiment of the invention.

The system comprises:

a plurality of agitators 10;

a storage area S where said plurality of agitators 10 are arranged;

a moving device 16 for moving said agitators 10 at least between said storage area S and said container 12;

a control system for controlling and coordinating the operations of the system;

said agitators 10 comprising a locking mechanism 18 for fixing said agitator 10 to said respective container 12 in a removable manner.

The part of agitators 10 that is designed to come into contact with the fluid, in order to agitate/mix it, also known as agitating portion, can be made according to known types, such as, for example, blades 100 rotating around an agitation axis 102, movable blades, protuberances, helical elements, etc.

The locking mechanism is suited to create a mechanical constraint, preferably a removable one, between the agitator 10 and the respective container 12 associated with it, which is useful during the agitation operations and further operations to be carried out in the system. With reference to the example shown in the aforementioned figure, container 12 has a substantially cylindrical shape, with an upper opening where agitator 10 is fixed. Therefore, locking mechanism 18 allows operators to keep the position between agitator 10 and respective container 12 fixed as some operations are carried out in the system, especially during the agitation of the fluid in the container, thus preventing these parts from detaching or sliding, even in case of very viscous fluids.

Figure 4:
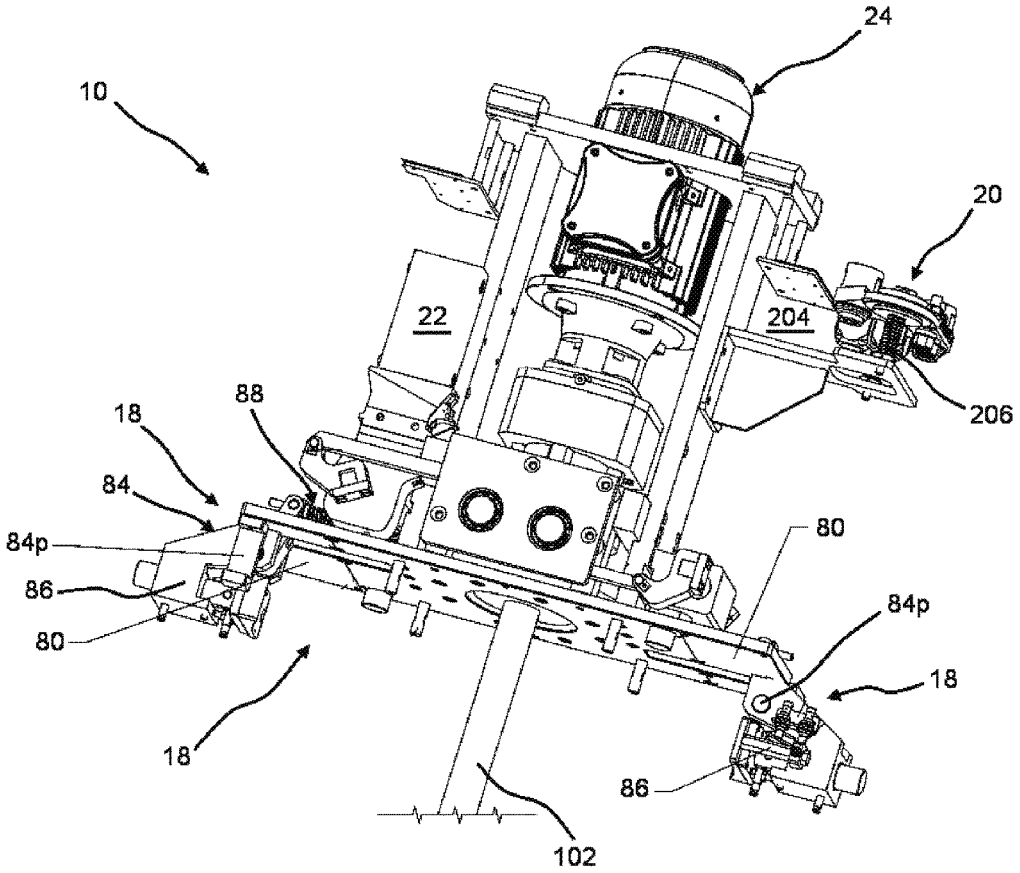
FIG. 4 is a perspective view of an agitator according to a particular embodiment.
Figure 5A:
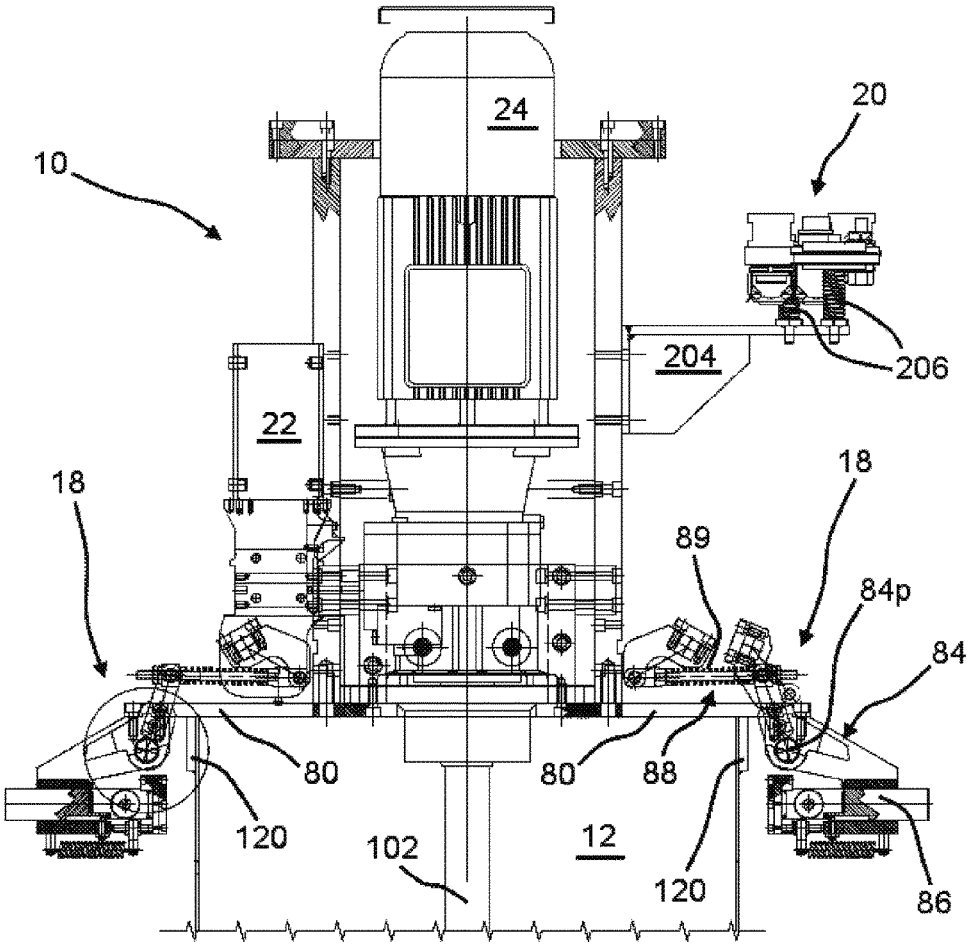
FIGS. 5*a* and 5*b* are two front views of the agitator of FIG. 4; in particular.
Figure 5B:
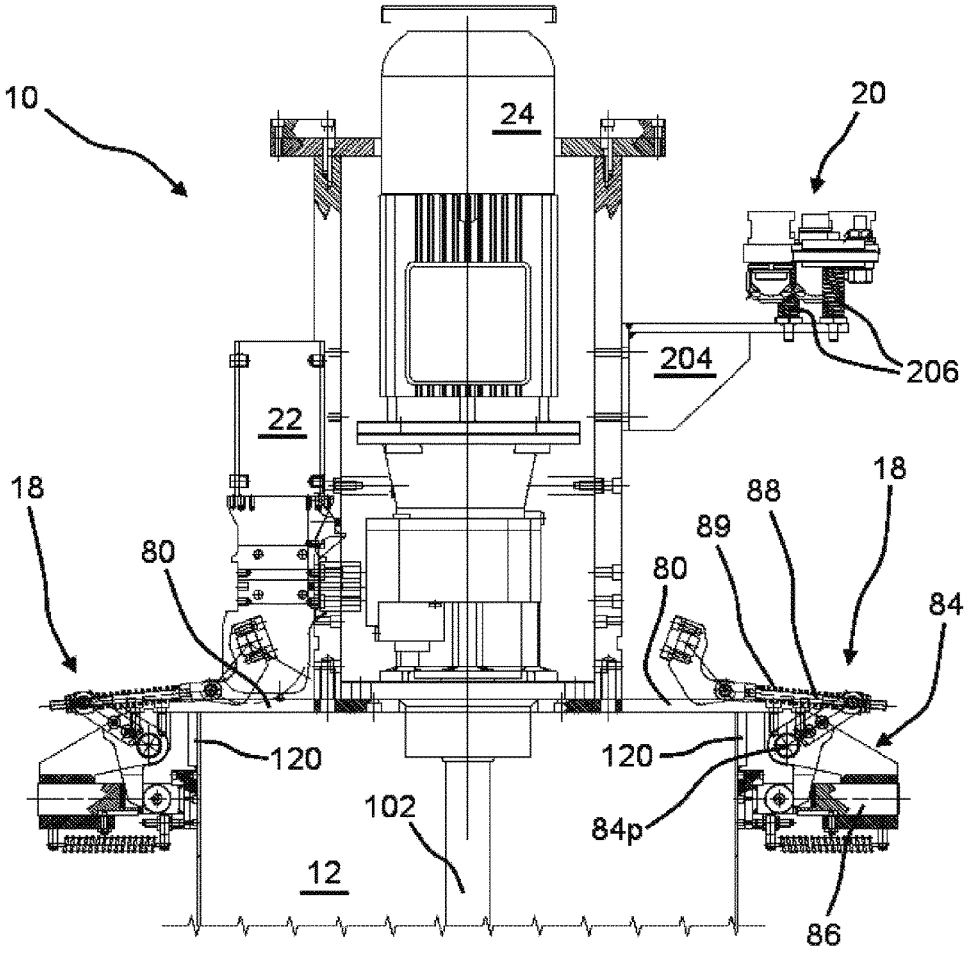

Locking mechanism 18, shown by way of example in FIGS. 4, 5*a* and 5*b*, has two protuberances 80, which are designed to be constrained to the upper edge of container 12. These protuberances can be mechanical arms, clamps, etc.

Locking mechanism 18 can take on a release condition (FIG. 5*a*), in which is not constrained to container 12, as it does not exert upon it a mechanical constraining action, and an engagement condition (FIG. 5*b*), in which it is engaged with container 12, as it exerts upon it a mechanical constraining action.

In the example shown, the aforesaid protuberances 80 are metal plates, preferably arranged along the diameter of the respective circular container 12, each associated with a rocker arm 84, which is hinged to a fixed point (indicated with 84*p*) of respective protuberance 80. Rocker arm 84 is coupled, at a first end of its, to a striker element 86, for striking against container 12, when it is in said engagement condition, and, at a second end of its, to a pushing element 88. In the example shown, pushing element 88 is a connecting rod, which is hinged to said second end of rocker arm 84 and comprising elastic means 89, such as a spring, so as cause the container constraining and releasing movements to be more sensitive and progressive, thus decreasing the risk of wear and mechanical breaking.

Optionally, container 12 and locking mechanism 18 are shaped so as to improve the mutual mechanical engagement, for example by providing complementary projections/recesses. FIGS. 5*a* and 5*b* show a thickening 120 of the upper edge of container 12, which is able to improve the constraint to striker element 86, so as to more firmly support container 12.

Alternatively, mechanism 18 comprises mobile striker element, which slide along protuberances 80 to grab the container. This embodiment, just like the previous embodiments of mechanism 18, can be applied to containers with a parallelepiped-shaped cross-section.

Alternatively, mechanism 18 can be used in the form of a clamp—or a fork—for surrounding and grabbing the outer surface of container 12, for example by exerting a mechanical force upon it.

When locking mechanism 18 is fixed to container 12, blades 100 can be placed in the inner part of container 12 to stir the fluid. With reference to the example shown herein, agitator 10 extends in container 12 through axis 102—coaxial to cylindrical container 12—and has rotary blades 100.

Locking mechanism 18 preferably comprises an actuator 22, for controlling the reversible movement of locking mechanism 18 between said release condition and said engagement condition, for example by acting upon pushing element 88. Preferably, actuator 22 is pneumatic or hydraulic.

Conveniently, actuator 22 and locking mechanism 18 create a system that is bistable in said release condition and in said engagement condition; by so doing, the constraint between the container and the agitator remains firmer during the different operations and movements carried out in the system, without the need for actuator 22 to continuously exert a force towards the container.

According to the preferred embodiment shown in FIG. 4, agitator 10 comprises a motor means 24—or motor—for moving the agitating portion, which is suited to come into contact with the fluid, in order to agitate/mix it; in particular, motor 24 is able to cause the rotation of agitation axis 102 and, consequently, of blades 100 associated with it. Preferably, motor 24 is electric, more preferably brushless; however, the use of other known types of motor is also possible.

According to a convenient embodiment, agitators 10 comprise connection means 20 to receive the power supply needed to be activated. The power supply is preferably electrical, but it can also be pneumatic, hydraulic, mechanical, etc.

Preferably, electric motor 24 is supplied with power through connection means 20.

Conveniently, the system comprises at least one power supply point 30, for cooperating with said connection means 20 so as to supply power to said agitators 10. Preferably, power supply point 30 is suited to supply power to said connection means 20. For example, each power supply point 30, which supplies power to connection means 20 and, consequently, to agitator 10, is connected to an external power supply network of the system or to a dedicated generator.

When agitator 10—associated with respective container 12—is connected to a power supply point 30 through said connection means 20, agitator 10 is in an active condition, in which it is ready to fulfill its function. For example, as we will explain more in detail below, agitator 10 is able to move so as to agitate the fluid or be washed in a suitable washing station, after having agitated or stirred the fluid.

Figure 6:
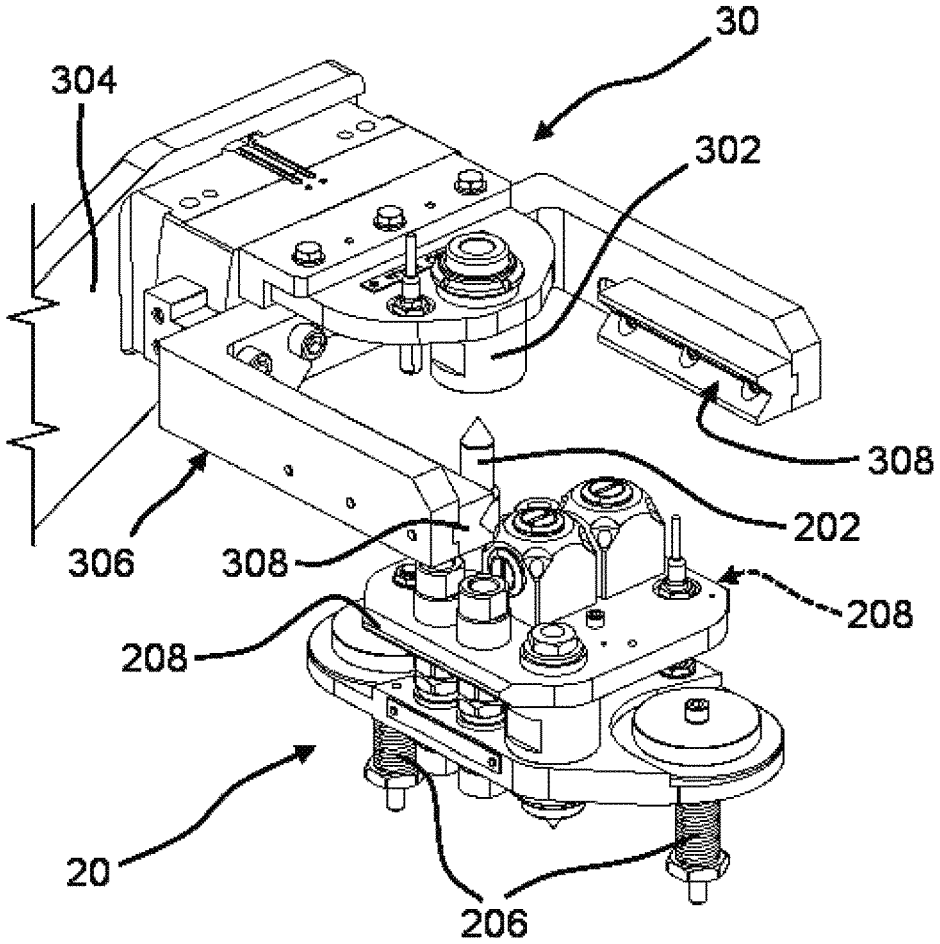
FIG. 6 is a perspective view of a detail of the invention according to a particular embodiment.

According to a preferred embodiment shown in FIG. 6, the aforesaid connection means 20 as well as power supply point 30 are shaped so as to form a mutual engagement system of the "plug-socket" type. In particular, connection means 20 are shaped like a plug—with at least one protuberance 202—and power supply point 30 is shaped like a socket—with at least one hollow element 302 designed to receive a protuberance 202.

Conveniently, the aforesaid connection means 20 as well as power supply point 30 are intended for safe use in potentially explosive atmospheres, for example pursuant to directive 94/9/CE and/or 99/92/CE "ATEX". This solution allows the present invention to be used in extremely safe conditions, thus minimizing or completely eliminating the risk of detonation in potentially explosive atmospheres, which might cause serious damages to things and people. This feature seems to be especially convenient in plants for the production of paints, solvents, dyes and the like, where the presence of inflammable vapors is highly frequent, due to the chemical composition of these products or due to chemical reactions caused by the mixture of different products.

For example, power supply point 30 is provided with a sensor to detect the correct engagement of connection means 20; the control system allows power to be supplied only after having detected, by means of said sensors, a correct engagement. By so doing, the possibility to generate sparks or undesired electric discharges is eliminated or, anyway, minimized.

According to a preferred embodiment, at least one between said power supply point 30 and said connection means 20 is constrained in a movable manner relative to a respective support element, so as to facilitate the mutual mechanical engagement.

With reference to the example shown in FIGS. 4, 5*a*, 5*b* and 6, connection means 20 are constrained in a movable manner relative to a respective first support element 204 of agitator 10 by means of elastic means 206, such as springs. In this way, connection means 20 gain a clearance that allows them to move (for example, by translating and/or rotating) relative to a "reference" position in which they cooperate with power supply point 30. Elastic means 206, when agitator 10 is not in power supply point 30, take connection means 20 back to said "reference" position.

Alternatively, power supply point 30 is constrained in a movable manner relative to a respective second support element 304, such as a bracket.

As a matter of fact, if connection means 20 and power supply point 30 were intended to take on fixed positions, the tiniest imprecision in the manufacturing of the parts or an imprecise movement of the connection means would make the cooperation between connection means 20 and power supply point 30 difficult, thus possibly causing the impossibility to operate the system and provoking damages to parts of the system. For greater clarity: if, by mere way of example, the connection means were shaped as a plug and the power supply point was shaped as a socket, the absence of the aforesaid clearance could cause the impossibility to effectively insert the plug into the socket.

By so doing, the system gains greater reliability and, therefore, is allowed to operate despite the frequent practical imperfections.

Conveniently, power supply point 30 comprises a restraining means 306, for more firmly maintaining the mechanical engagement between connection means 20 and power supply point 30. This solution is particularly useful during those operation in which agitator 10 is subject to stresses or vibrations that are potentially able to disconnect connection means 20 from power supply point 30, thus causing undesired interruptions of the operation of the system.

With reference to the non-limiting embodiment shown in FIG. 6, restraining means 306 is shaped like a fork element having a pair of projections/recesses 308, for mechanically engaging, in a releasable manner, a respective pair of recesses/projections 208 of connection means 20.

Conveniently, the arms of fork element 306 are movable, for example by means of an actuator controlled by the control system, so as to allow connection means 20 to be easily inserted into and removed from power supply point 30.

According to a preferred embodiment, the system comprises an agitation station A to agitate, by means of said agitator 10, the fluid contained in said container 12. In particular, agitation station A is provided with said power supply point 30.

Conveniently, said agitation station AD, for example shown in FIG. 1, is also suited to dose one or more fluids into said container 12 simultaneously with the agitation. This allows operators to dose different components of a fluid substance (e.g. colored fluids, solvents, powders, etc.) and, at the same time, agitate these substances in container 12, so as to obtain a more homogeneous fluid product, thus minimizing the defects arising from agglomeration or segregation phenomena.

FIG. 1 shows a preferred embodiment comprising three agitation stations A, AD, one of them (indicated with AD) being suited, furthermore, to dose one or more fluids into container 12.

With particular reference to agitation station AD, which is also able to carry out the dosing operation, it is preferable to use an agitator 10 that is shaped so as to create an opening—or mouth—through which a dosing element of station AD can introduce one more fluids into container 12, when agitator 10 is associated with respective container 12. In this way, operators can introduce one or more fluids into container 12, without having to dissociate agitator 10 from container 12, thus increasing the practicalness and the productivity of the system. As a matter of fact, even if agitator 10 and container 12 are associated, fluids can be introduced through said opening.

This solution proves to be advantageous even when the system is provided with a station dedicated to the sole dosing operation.

Agitator 10 and, in particular, locking mechanism 18 comprising protuberances 80, which are shown in the figures by way of example and were described above, make up a preferred embodiment of the invention, which is able to create one or more openings between container 12 and respective agitator 10, through which fluids can be introduced without having to dissociate container 12 and agitator 10.

However, according to a different variant that is not shown herein, there is provided the use of agitators 10 that are able to completely obstruct container 12 with which they are associated. This particular manufacturing choice could be applied to a system in which no dosing operation is carried out to dose one or more fluids into container 12.

The system also comprises an input station I, which allows containers 12 to be fed into and out of the system.

Optionally, the system comprises a weighing system, for example provided with scales, to weigh the container and, if necessary, its content. This weighing system can possibly be included in agitation station AD, so as to detect the weight of the fluid dosed.

According to a preferred variant, system comprises a washing station L to wash said agitators 10 coming from a container 12 and moved by said moving device 16.

Figure 8:
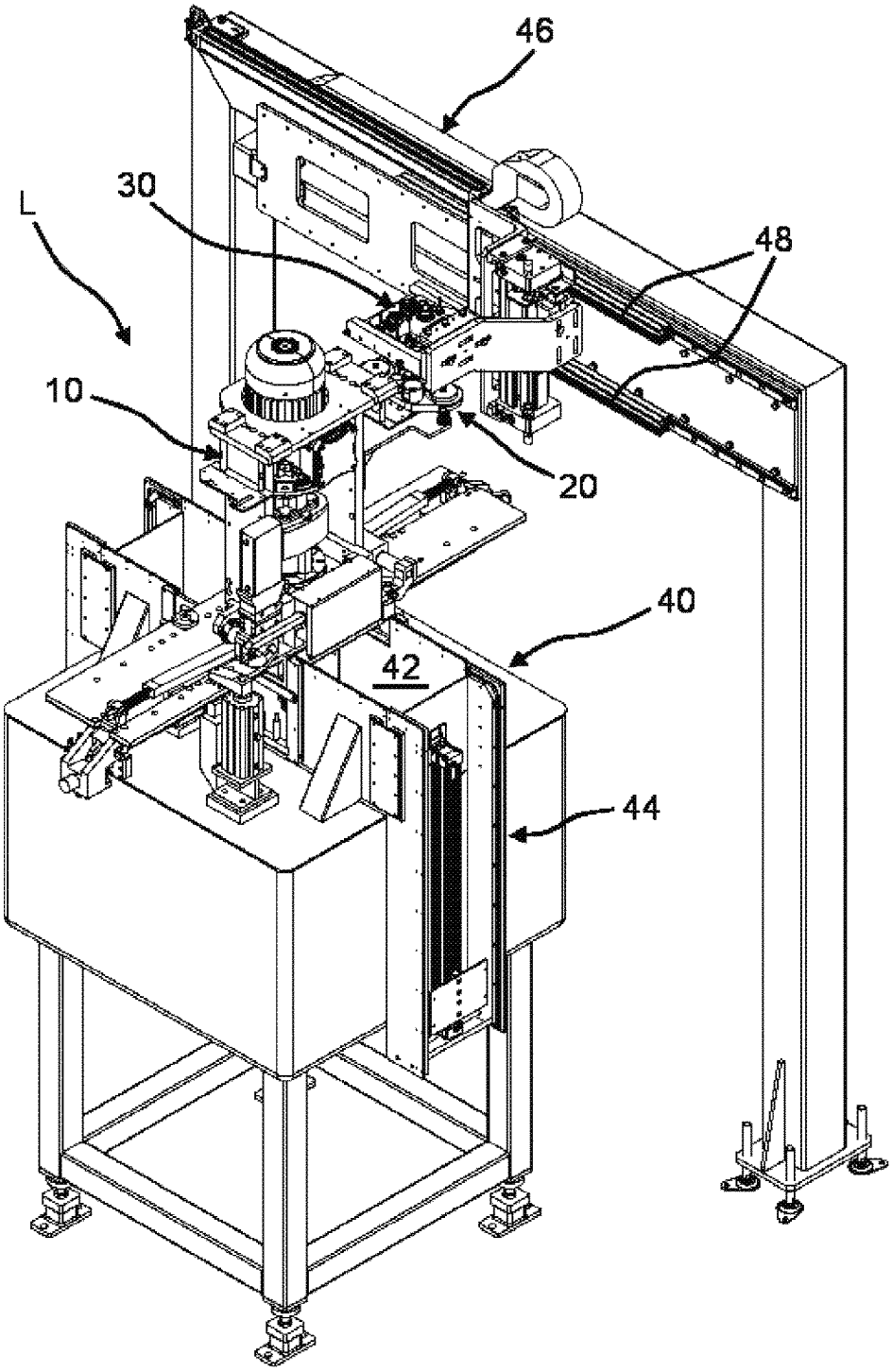
FIG. 8 is a perspective view of a washing station of the invention according to a particular embodiment, into which an agitator is partially inserted.

With reference to FIG. 8, washing station L is conveniently provided with a washing chamber 40, for at least partially accommodating an agitator 10; chamber 40 contains, on the inside, substances used to remove fluid residues, for example left on the agitating portion, which might contaminate the following agitation steps. The chamber comprises, furthermore, means to dispense washing substances, such as for example: water, soap, solvent, detergent substances, disinfectant substances, etc.

Conveniently, washing station L comprises, furthermore, said power supply point 30. Power supply point can be used to supply power, for example electrical power, to agitator 10, in order to move the agitator when it is on the inside of washing chamber 40, so as to improve the washing and the cleaning of said agitator 10. For example, if the agitator has rotary blades 100, blades 100 of agitator 10 can be caused to rotate in washing chamber 40.

Washing chamber 40 comprises an opening 42 to permit an at least partial insertion of the agitating portion. In particular, opening 42 has an oblong shape, for example a rectangular one, to allow rotary blades 100 to be introduced into washing chamber 40.

Washing chamber 40 can also comprise a closing system 44 to close opening 42 when agitator 10 is being washed, thus avoiding the outlet of washing fluids, such as water squirts, drops, splashes, etc.

Closing system 44 can be, for example, a sliding shutter or door, preferably operated and controlled by the control system, in coordination with the washing operation.

When the agitator is associated with the respective container 12, for example at the end of the agitation and, if available, dosing steps, moving device 16 disassociates agitator 10 from container 12 and moves agitator 10 towards washing station L. At the end of the washing cycle, moving device 16 picks up agitator 19 and moves it to storage area S, where it lays it down, waiting to be subsequently used; or it associates agitator 10 with a container 12 fed into the system. Alternatively, at the end of the agitation and, if available, dosing steps, moving device 16 disassociates agitator 10 from container 12 and moves agitator 10 towards storage area S, where it lays it down, waiting to be subsequently used; or it associates agitator 10 with a container 12 fed into the system.

Washing station L advantageously allows operators to remove traces of fluid substances that came into contact with the agitator, for example during the agitation and, if available, dosing steps on the inside of the respective container, so as to cause said agitator to be ready to be subsequently reused in association with a different container. A clean agitator does not alter, in an undesired manner, the composition of the fluid substance to be obtained.

Preferably, at least one among said washing station L, said agitation station A, and said moving device 16 comprises a power supply point 30, for cooperating with said connection means 20 so as to supply power to said agitators 10.

According to the particular variant shown in FIGS. 1 and 6, power supply point 30 of washing station L is associated with a respective support structure 46 (in the example, a portal) in a movable manner. In this way, there are no interferences between moving device 16 and power supply pint 30 during the insertion and the removal of agitator 10 into and from washing station L.

In particular, power supply point 30 of washing station L can slide on a pair of guides 48 associated with portal 46.

According to a preferred embodiment, said agitator 10 comprises a sensor, for detecting the arrangement of said agitator in the space relative to a predetermined space reference system, such as, for example, a Cartesian system. In particular, said sensor detects the angular orientation of blades 100, in case the agitator comprises rotary blades 100.

The sensor, for detecting the arrangement of said agitator in the space, can be of a known type, for example an optical sensor, a laser sensor, a magnetic sensor, a proximity sensor, a photodetector, etc.

In this way, agitator 10 can more easily be inserted into and extracted from storage area S and/or washing station L.

For example, the aforesaid sensor detects the orientation of rotary blades 100 and checks whether they are oriented in such a way that allows them get into opening 42 of washing chamber 40; if they are correctly oriented, the insertion takes place; if they are not correctly oriented, blades 100 are rotated until they reach the correct orientation and then the insertion takes place. The same also applies to the extraction at the end of the washing cycle.

Figures from 9*a* to 9*e* show an operating sequence of washing station L.

Figure 9A:
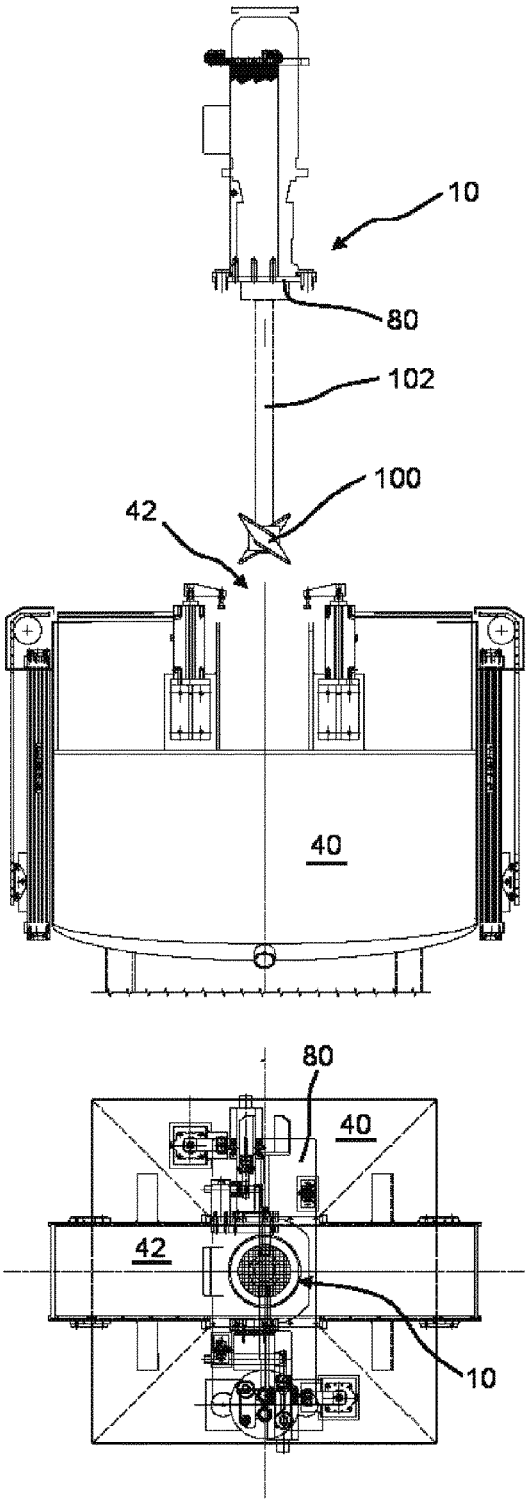
FIGS. 9*a*, 9*b*, 9*c*, 9*d*, 9*e* show, in sequence, an agitator in the washing station; each figure shows a front view and a plan view; in particular.

FIG. 9*a*: agitator 10 and blades 100 are still on the outside of washing chamber 40.

Figure 9B:
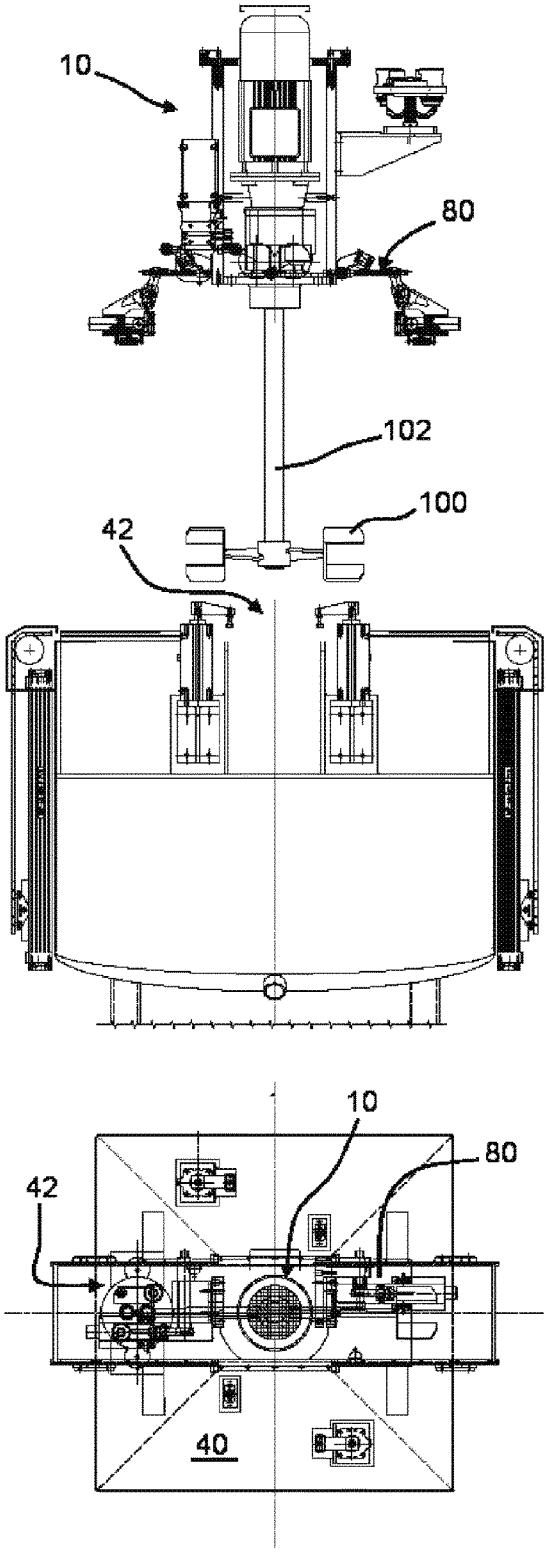

FIG. 9*b*: agitator 10, still on the outside of washing chamber 40, is rotated by 90°, conveniently by means of moving device 16, in an integral manner together with blades 100; namely, during this rotation step, blades 100 keep a fixed position relative to agitator 10.

Figure 9C:
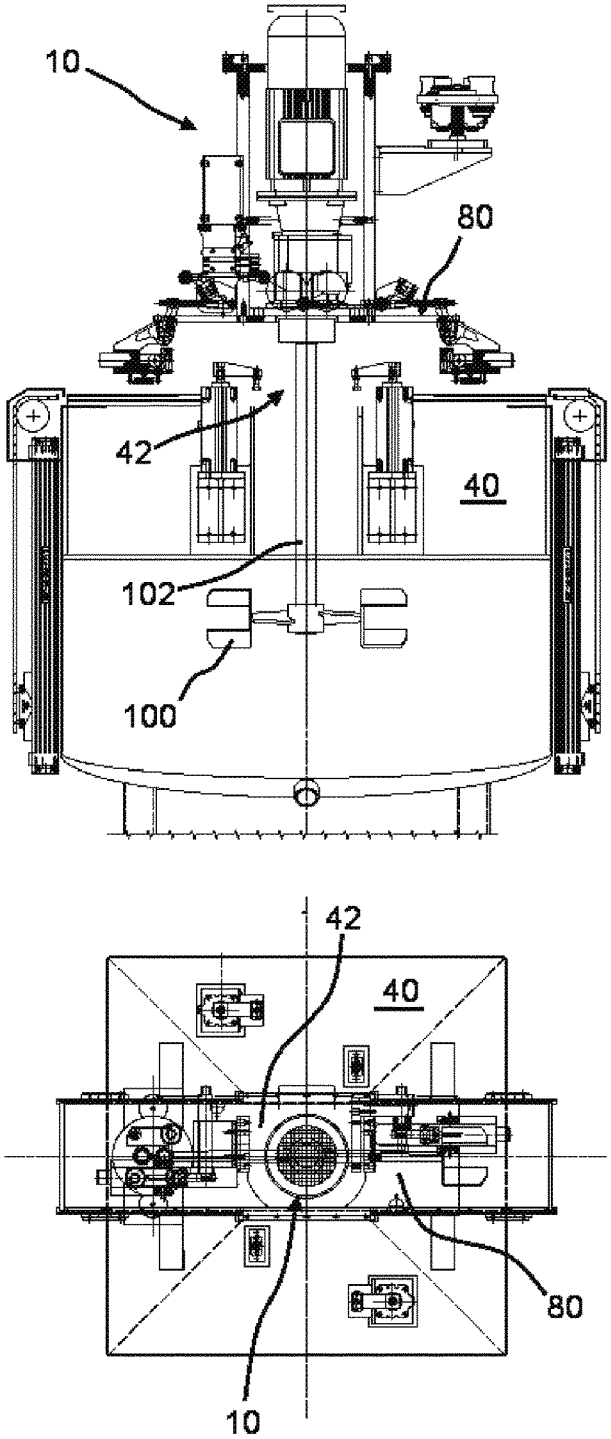

FIG. 9*c*: agitator 10 is partially inserted into washing chamber 40.

Figure 9D:
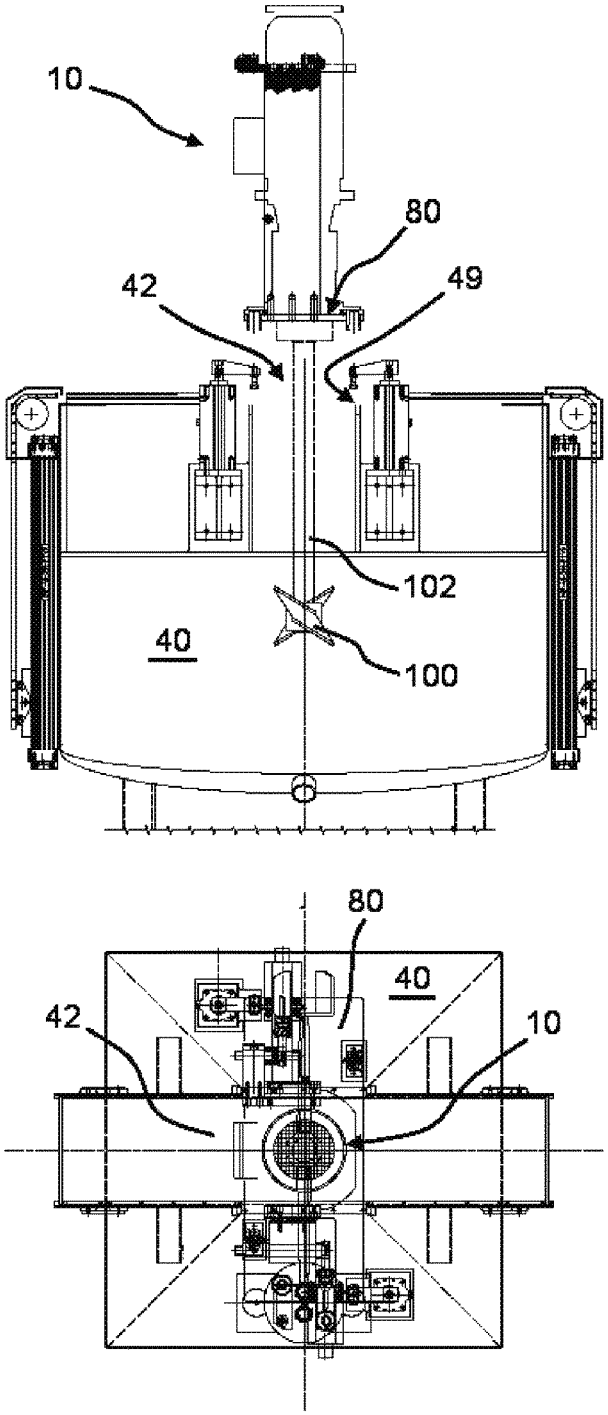

FIG. 9*d*: the partially inserted agitator 10 is further rotated by 90°; during this rotation step, again, blades 100 keep a fixed position relative to agitator 10.

Figure 9E:
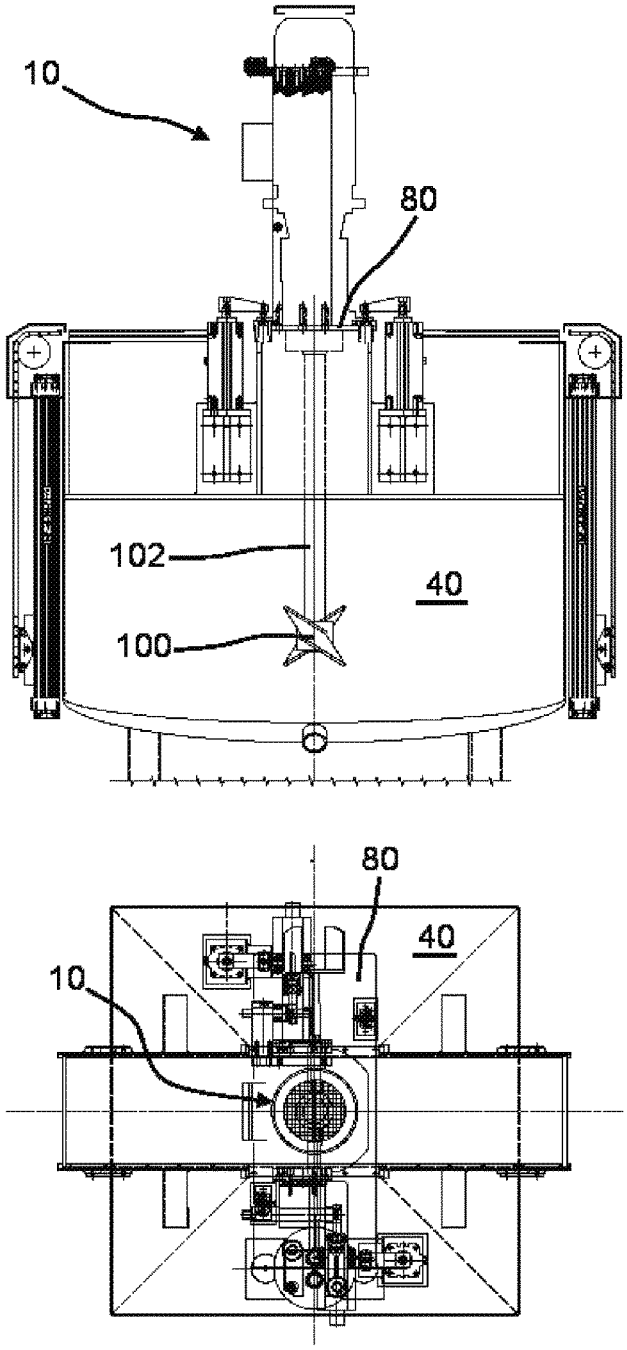

FIG. 9*e*: agitator 10 is secured to washing chamber 40, thus obstructing opening 42.

Through the rotation of agitator 10, connection means of the agitator can be placed close to power supply point 30 of washing station 40, thus enabling their mutual connection; by so doing, for example, blades 100 can be caused to rotate during the washing cycle.

Furthermore, the washing station 40 comprises a support portion 49 to support agitator 10; in this way, power supply point 30 of washing station L can be associated with agitators 10 different shapes and sizes. Conveniently, support portion 49 is provided with a hooking mechanism to constrain, in a removable manner, agitator 10 to washing chamber 40 during the washing cycle, by means of locking mechanism 18, for example through protuberances 80.

It also possible to cause, besides the rotation of entire agitator 10, the rotation of blades 100, so as to facilitate their insertion through opening 42; this rotation of blades 100 is conveniently carried out thanks to the connection of connection means 20 used to connect power supply point 30 to moving device 16.

Alternatively, opening 42 of washing chamber 40 has a shape and a size that allow agitator 10 to be inserted/extracted irrespective of its position in the space; therefore, the use of the aforesaid sensor is not needed. Similarly, storage area S has a shape and a size that allow agitator 10 to be inserted/extracted irrespective of its position in the space.

Conveniently, agitator 10—which, for example, comprises rotary blades 100—is operated by means of motor means 24, which is preferably supplied with power by power supply point 30 through connection means 20. In a preferred variant, storage area S comprises a rack 50, in which agitators 10 are picked up and then put back, see FIGS. 7*a* and 7*b*.

Figure 7A:
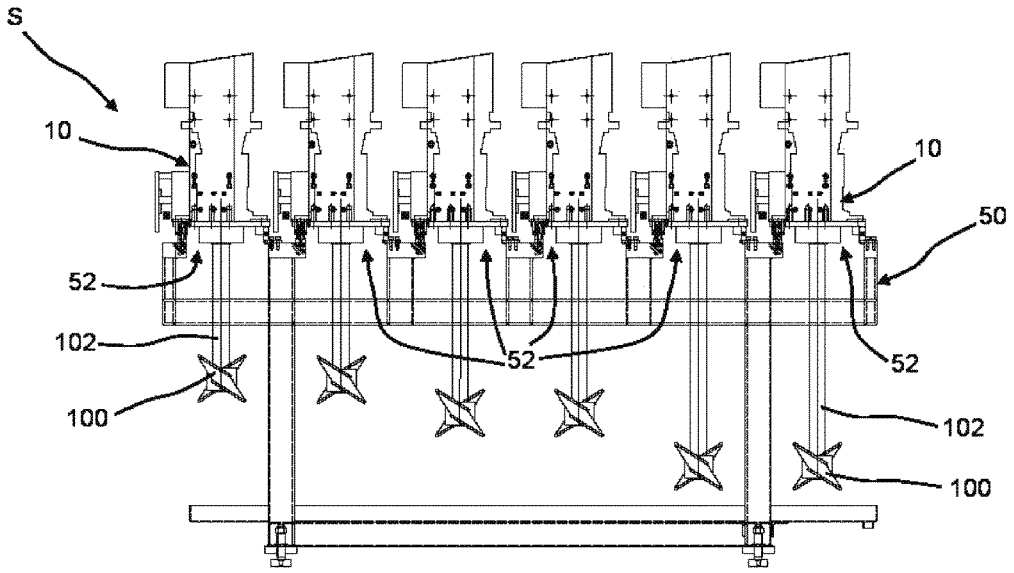
FIGS. 7*a* and 7*b* are a front view and a plan view, respectively, of a storage area according to a particular embodiment.
Figure 7B:
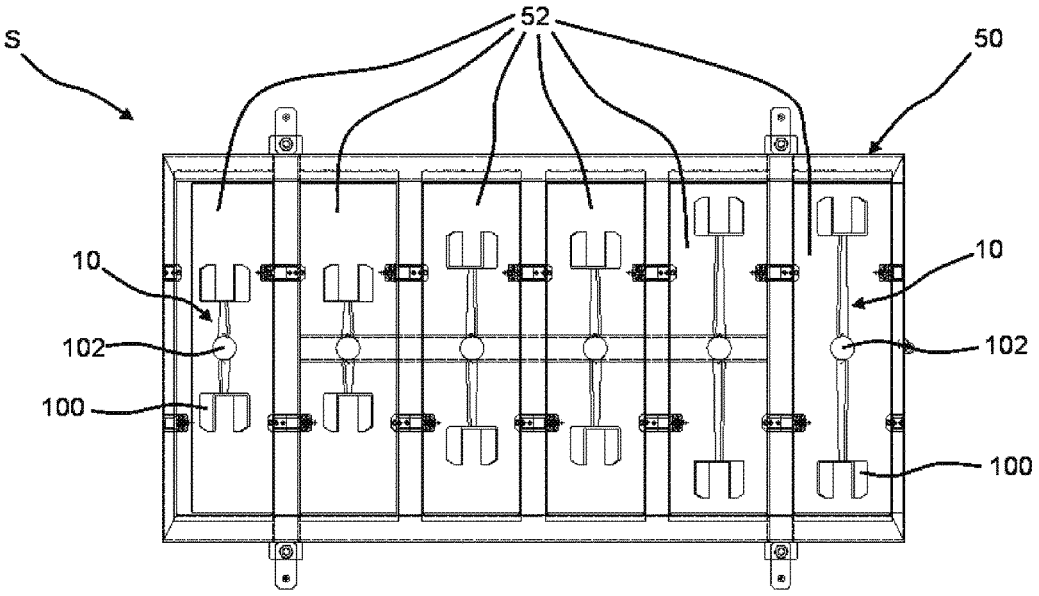

Rack 50 comprises a plurality of seats 52, which, in the plan view of FIG. 7*b*, have an oblong shape, in particular a rectangular one. These seats 52 are conveniently equally oriented in a parallel fashion, so as to reduce the space taken up by the system. Each seat 52 of rack 50 is designed to accommodate a respective agitator 10; the example shows blades 100 arranged parallel to one another.

With particular reference to the example shown herein, seats 52 are suited to permit the introduction of axis 102—with relative blades 100—into rack 50 and to keep agitator 10 in position.

Said seats 52 comprise edges that allow agitators 10 to rest one protuberances 80. Hence, the protuberances also conveniently fulfill the function of supporting agitators 10 in relative seats 52.

Said seats 52 comprise sensors, for detecting the presence of the respective agitator.

For the sake of brevity, in FIGS. 7*a* and 7*b* only two agitators 10 are numbered: one on right and one on the left of each figure.

In particular, the figures show six agitators consisting of three pairs of agitators with different sizes. The presence of agitators 10 with different sizes and, if necessary, of different types allows operators to work in containers 12 with different sizes and/or shapes, thus making the system highly versatile in its use.

Optionally, the system comprises sensors to identify the position of said containers 12 in the space. These sensors allow the control system to detect the position of one or more containers 12, so as to carry out the necessary operations, among which there are: associating/removing agitator 10 with/from respective container 12, minimizing positioning mistakes that might cause a wrong constraint;

furthermore, possible impacts between container 12 and agitator 10 can be minimized or eliminated, as well.

Figure 2:
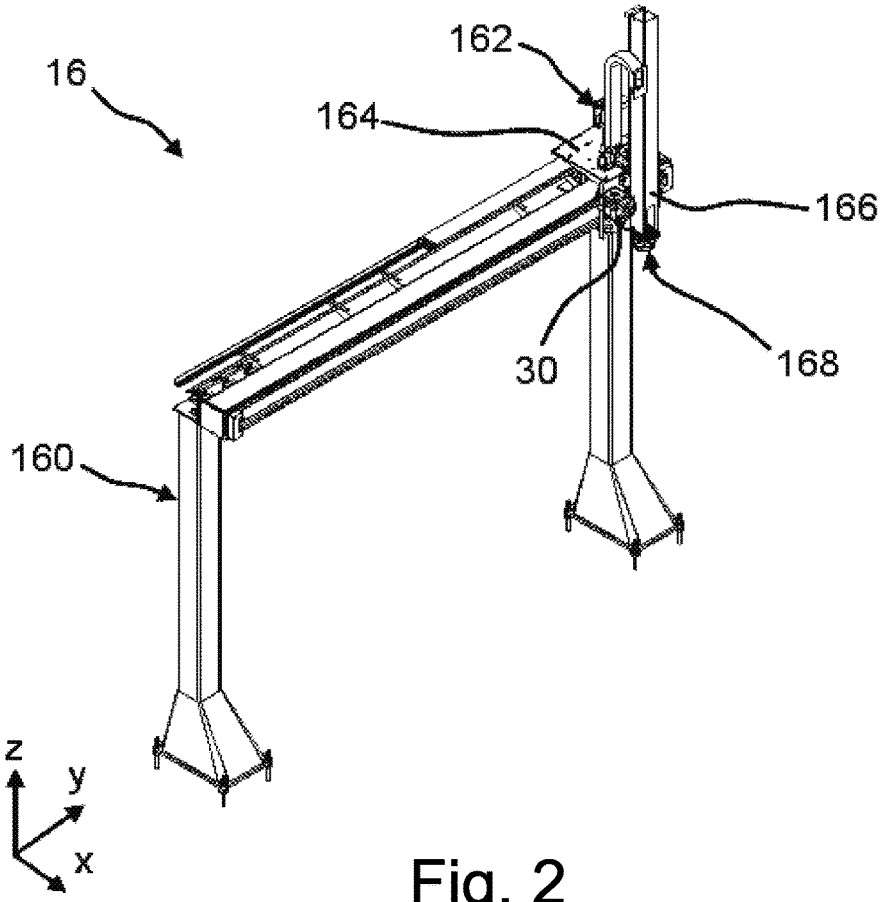
FIG. 2 is a perspective view of a moving device according to a first embodiment.
Figure 3:
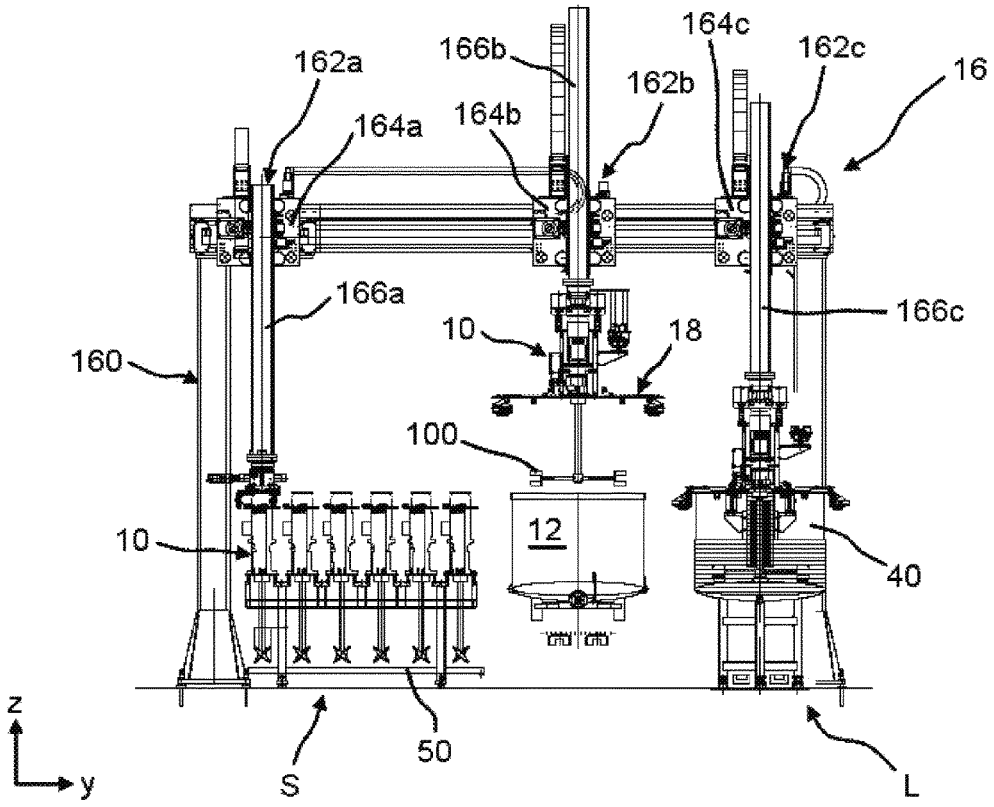
FIG. 3 is a front view of the moving device of FIG. 2.

With non-limiting reference to the preferred embodiment shown in FIGS. 1, 2 and 3, moving device 16 is at least able to move said agitators 10 along a substantially vertical plane z-y and to rotate said agitators 10 around a first substantially vertical axis z.

Conveniently, moving device 16 comprises:

a bearing structure 160; and a grip element 162, which is mobile relative to said bearing structure 160 and is designed to pick up, release and move said agitators 10.

In the example shown, bearing structure 160 is a portal lying on a substantially vertical plane z-y and comprising, in particular, two vertical elements and a cross element resting on the vertical elements.

Grip element 162 shown herein comprises:

a first mobile portion 164, which is able to move, in particular in a sliding manner, relative to the cross element along direction y; and a second mobile portion 166, which is able to move, in particular in a sliding manner, relative to said first mobile portion 164, along direction z;

an engagement element 168, which is designed to engage, in a removable manner, a respective agitator, so as to move it, for example from storage area S towards a respective container 12 fed in. Engagement element 168 can comprise known elements, among which there are: a quick release system, a fork, a clamp element, a jaw element, an interlocking system, etc.

Therefore, the cooperation between the first mobile portion 164 and the second mobile portion 166 permits a plurality of movements on plane z-y.

Optionally, grip element 162 comprises a third mobile portion (not shown), which is able to move along axis x, for example relative to a second mobile portion 166. Alternatively, grip element 162 can translate along axis x. In this way, a plurality of three-dimensional movements are available, through which agitator 10 can be moved.

As already mentioned above, moving device 16 shown herein is able to rotate said agitators 10 around a first substantially vertical axis z. This freedom of movement allows blades 100 of agitator 10 to be rotated even when said agitator 10 is not connected to power supply point 30 and, therefore, is in a non-supplied condition, in which said blades 100 would not be able to rotate, for example due to motor 24 connected to power supply point 30 through connection means 20.

FIG. 3 shows moving device 16 represented in FIG. 2 in three different explanatory operating conditions, so as to better understand how it works. For the sake of clarity, the different operating conditions takes on by moving device 16 are associated with different alphabetical references.

First operating condition: the first mobile portion 164*a* of grip element 162*a* is on the left of the figure to pick up an agitator 10 from rack 50 in storage area S. The second mobile portion 166*a* is in a lowered condition to mechanically engage one of agitators 10 shown in the figure.

Second operating condition: the first mobile portion 164*b* of grip element 162*b* has moved towards the center of the figure and the second mobile portion 166*b* has taken on a raised condition, so as to associate agitator 10, previously picked up from rack 50, with respective container 12 through the locking mechanism. Agitator 10, for example, comes from input station I. After having associated agitator 10 with respective container 12, they (10, 12) are ready to move in the system in order to carry out the necessary operations, thus temporarily abandoning moving device 16.

Third operating condition: the first mobile portion 164*c* of grip element 162*c* has moved towards the right side of the figure and the second mobile portion 166*c* has taken on a lowered condition, so as to introduce agitator 10 into washing chamber 40 of washing station L. Before introducing agitator 10 into washing chamber 40, agitator 10 must be released from respective container 12, for example after operations carried out in the different stations of the system. Container 12—now free from the agitator—is conveniently expelled from input station I. After this washing step, moving device 16 is conveniently brought back to the first operating condition and is ready to restart the cycle.

We would like to point out that in FIG. 3 there is one single moving device 16 shown in three different operating conditions: numbers 162*a*, 164*a*, 166*a* are assigned to the first operating condition; numbers 162*b*, 164*b*, 166*b* are assigned to the second operating condition; numbers 162*c*, 164*c*, 166*c* are assigned to the third operating condition.

According to further variants of the invention, moving device 16 comprises one or more of the following elements: a robot, an automated mechanical arm, a frame with a shape other than the one shown herein having, for example, a three-dimensional extension, etc.

According to further variants of the invention, moving device 16 is able to cause agitators 10 to carry out any translation and/or rotation in the space.

The system preferably comprises moving means to move containers 12, if necessary when they are associated with respective agitator 10, among the different areas of the system itself; for example, among input station I, washing station L, agitation station A, AD. The moving means can be known moving means, such as forks, rollers, mobile platforms, robots, mechanical arms, cranes, etc.

Furthermore, according to the present invention, there is provided a method to associate an agitator 10 with a respective container 12 for containing fluid, such as paint, said method comprising the following steps:

picking up an agitator 10 from a storage area S, where a plurality of agitators 10 are arranged, by means of a moving device 16;

moving said agitator 10 between said storage area S and said container 12 by means of said moving device 16;

fixing said agitator 10 to said container 12 in a removable manner by means of a locking mechanism 18.

Conveniently, this method is carried out by means of the automated system to associate an agitator 10 with a respective container 12 for containing fluid according to the present invention.

Preferably, the method also comprises the step of:

connecting said agitator 10 to at least one between a washing station L and an agitation station A, AD, so as to supply power to said agitator 10, thus causing it to be activated, by means of connection means 20.

Conveniently, the method also comprises the steps of:

detecting the arrangement of said agitator 10 in the space relative to a predetermined space reference system by means of at least one sensor able to detect the arrangement of said agitator 10 in the space;

correcting the arrangement of said agitator 10 in the space, if the arrangement in the space differs from a predetermined arrangement in the space.

Preferably, the method comprises the steps of:

removing said agitator 10 from respective container 12 by means of said locking mechanism 18;

placing said agitator 10 in said storage area S by means of said moving device 16.

Preferably, the method described above in a non-limiting manner is carried out under the control of the control system.

By way of example, we are going to explain the operation of a variant of the present method carried out by means of a variant of the system.

Container 12 is introduced into the system through input station I. Moving device 16 picks up an agitator 10 from storage station S, moves it towards container 12 and associates it with container 12 by means of locking mechanism 18. Then, container 12 and the agitator are disassociated from moving device 16. Subsequently, the feeding means move container 12 to agitation station AD, where the fluid component dosing step takes place simultaneously with the agitation of the content of container 12. Agitator 10 is connected to the power supply point 30 of agitation station AD through connection means 20. Subsequently, the moving means move container 12 to agitation station A, where the sole agitation step takes place; agitator 10 is connected to power supply point 30 of agitation station A. At the end of the operations carried out in stations A and AD, connection means 20 are disconnected from power supply point 30 of the respective agitation station A, AD. Now, the moving means move container 12 and the agitator associated therewith to moving device 16, which disassociates agitator 10 from respective container 12. Subsequently, moving device 16 takes agitator 10—just disassociated and with residual traces of fluid substances—to washing station L, where it places and releases agitator 10. Connection means 20 are connected to power supply point 30 of washing station L and the washing cycle is carried out. At the end of the washing cycle, moving device 16 picks up agitator 10 and takes it to storage station S, where it releases it, ready to be used again. Finally, container 12—now filled with fluid—is expelled from the system through input station I.

A computer program can be provided, which is able to actuate the method.

One of the many advantages of the present invention is that it makes it possible for different containers 12 (conveniently, three of them), even with different shapes and sizes, to be present at the same time in the system, thus increasing the productivity thereof.

Figure 10:
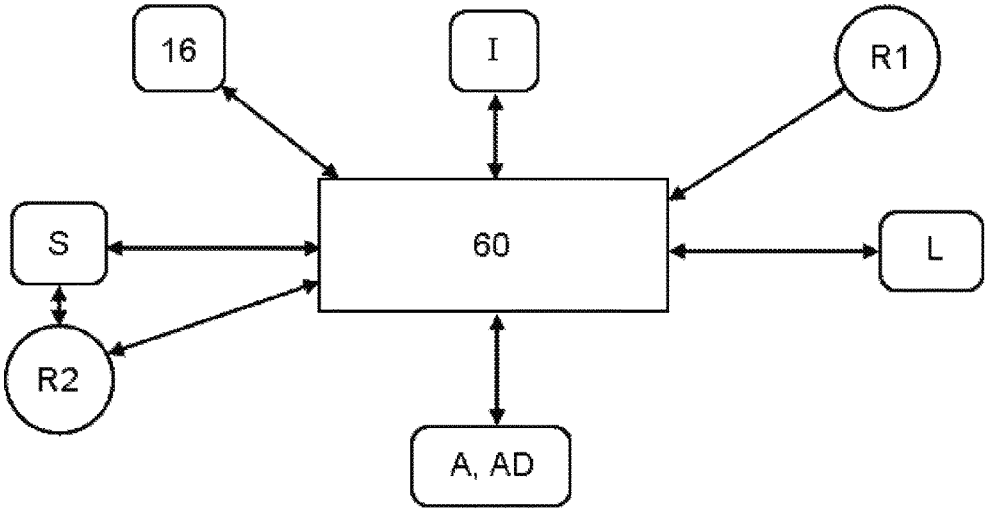
FIG. 10 shows a flowchart of a control system.

FIG. 10 shows a flowchart of control system 60, which is able to interact with one or more sensors and with one or more stations by sending and/or receiving signals.

In the explanatory and non-limiting embodiment, control system 60 interacts with input station I, agitation station A (if necessary, even the one used for dosing operations AD), washing station L, storage area S, moving device 16, and the sensors indicated with R1 and R2. The double arrow indicates that signals can be sent and received between control system 60 and the stations (or the sensors).

For example, control system 60 controls and coordinates the operations of moving device 16 by sending signals, but it is also able to receive signals sent by moving device 16, which indicate the occurrence of an operating condition, such as a fault condition, a condition of engagement with agitator 10, etc.

Sensor R1, on the other hand, is only able to send signals to control system 60; as a matter of fact, the line has one single arrow pointing at control system 60. For example, R1 is a sensor designed to detect the arrangement of said agitator 10 in the space relative to a predetermined space reference system; in case the arrangement is correct, control system 60 will provide further instructions to the system.

By way of example, again, at least one station, such as storage area S, comprises at least one electronic control unit, which is able to interact with one or more sensors pertaining said station. In the example, R2 is a sensor that is able to detect the presence of an agitator in storage area S. As you can see, said sensor R2 is able to send/receive signals both relative to storage station S, through the electronic control unit, and relative to control system 60.

The sensors can be the ones mentioned in the present non-limiting description, or they can also be further possible sensors varying based on the operating needs of the specific case, without for this reason going beyond the scope of protection of the invention.

The system according to the present invention can be comprised in a plant for the production of fluids, such as paints, dyes, solvents and the like, having a plurality of known station and apparatuses that are not described herein.

Naturally, the principle of the present invention being set forth, embodiments and implementation details can be widely changed relative to what described above and shown in the drawings as a mere way of non-limiting example, without in this way going beyond the scope of protection provided by the accompanying claims.

KEY TO THE NUMERICAL REFERENCES

A, AD agitation, dosing station
I input station
L washing station
R1, R2 sensors
S storage area
agitator
100 blades
102 agitation axis
12 container
120 thickening
16 moving device
160 bearing structure
162 grip element
164 first mobile portion
166 second mobile portion
168 engagement element
18 locking mechanism
20 connection means
202 protuberance
204 support element
206 elastic means

208 recesses/projections
22 actuator
24 motor means
30 power supply point
302 hollow element
304 respective support element
306 restraining means
308 projections/recesses
40 washing chamber
42 opening
44 closing system
46 respective support structure
48 guides
49 support portion
50 rack
52 seats
60 control system
80 protuberances
84 rocker arm
84*p* fixed point
86 striker element
88 pushing element
89 elastic means

The invention claimed is:

1. An automated system to associate an agitator with a respective container for containing fluid, said system comprising:

a plurality of agitators;

a storage area where said plurality of agitators are arranged;

a moving device for moving said agitators at least between said storage area and said container;

a control system for controlling and coordinating operations of the system;

said agitators comprising a locking mechanism for removably fixing said agitator to said respective container;

said moving device comprises:

a bearing structure; and a grip element, which is mobile relative to said bearing structure and for picking up, releasing and moving said agitators.

2. The system according to claim 1, wherein said agitators comprise a connector to receive the power supply needed to be activated.

3. The system according to claim 2 comprising an agitation station to agitate, by said agitator, the fluid contained in said container.

4. The system according to claim 3, wherein said agitation station is adapted to dose one or more fluids into said container simultaneously with agitation.

5. The system according to claim 1, further comprising a washing station to wash said agitators coming from a container and moved by said moving device.

6. The system according to claim 1, wherein said agitator comprises a sensor for detecting the arrangement of said agitator in a space relative to a predetermined space reference system.

7. The system according to claim 1, wherein said moving device is able to move said agitators along a substantially vertical plane (z-y) and to rotate said agitators around a first substantially vertical axis.

8. The system according to claim 5, wherein at least one among said washing station, said agitation station, and said moving device comprises a power supply point, for cooperating with said connector so as to supply power to said agitators.

9. The system according to claim 8, wherein said power supply point is suited to supply power to said connector.

10. A plant to produce fluids, comprising:

a dosing station for said fluids; and an automated system according to claim 1.

11. A method to associate an agitator with a respective container for containing fluid using the system of claim 1, said method comprising the following steps:

picking up an agitator from the storage area, where the plurality of agitators are arranged, by the moving device;

moving said agitator between said storage area and said container by said moving device;

fixing said agitator to said container in a removable manner by the locking mechanism.

12. The method according to claim 11 and comprising the following steps:

connecting said agitator to at least one between a washing station and an agitation station, so as to supply power to said agitator to cause said agitator to be activated, by a connector.

13. The method according to claim 11 comprising the steps of:

detecting an arrangement of said agitator in a space relative to a predetermined space reference system by a sensor able to detect the arrangement of said agitator in the space;

correcting the arrangement of said agitator in the space, if the arrangement in the space differs from a predetermined arrangement in the space.

14. The method according to claim 11 and comprising the steps of:

removing said agitator from the respective container by said locking mechanism;

placing said agitator in said storage area by said moving device.

* * * * *